US005190438A

United States Patent [19]

Taniyama et al.

[11] Patent Number: 5,190,438

[45] Date of Patent: Mar. 2, 1993

[54] VACUUM PUMP

[75] Inventors: Minoru Taniyama, Ibaraki; Masahiro Mase, Tochigi; Kazuaki Nakamori, Ibaraki; Takashi Nagaoka, Tsukuba, all of Japan

[73] Assignee: Hitachi, Ltd., Tokyo, Japan

[21] Appl. No.: 682,265

[22] Filed: Apr. 8, 1991

[30] Foreign Application Priority Data

Apr. 6, 1990 [JP] Japan ..... 2-090344
Apr. 25, 1990 [JP] Japan ..... 2-107596

[51] Int. Cl.[5] ..... F04D 29/58

[52] U.S. Cl. ..... 415/90; 415/175; 415/178

[58] Field of Search ..... 415/90, 175, 177, 178, 415/179; 417/423.4

[56] References Cited

U.S. PATENT DOCUMENTS

| | | | |
|---|---|---|---|
| 3,324,970 | 6/1967 | McHugh | 415/90 |
| 3,536,418 | 10/1970 | Breaux | 415/90 |
| 4,283,167 | 8/1981 | Bassam et al. . | |
| 4,668,160 | 5/1987 | Mase et al. . | |
| 4,734,018 | 3/1988 | Taniyama et al. . | |
| 4,904,155 | 2/1990 | Nagaoka et al. . | |
| 4,929,151 | 5/1990 | Long et al. | 415/90 |

FOREIGN PATENT DOCUMENTS

| | | | |
|---|---|---|---|
| 557563 | 6/1957 | Belgium . | |
| 2757599 | 6/1979 | Fed. Rep. of Germany . | |
| 2804653 | 8/1979 | Fed. Rep. of Germany . | |
| 3022147 | 1/1982 | Fed. Rep. of Germany . | |
| 212395 | 12/1982 | Japan | 415/90 |
| 25994 | 2/1986 | Japan | 415/90 |
| 171896 | 8/1986 | Japan . | |
| 247893 | 11/1986 | Japan . | |
| 29796 | 2/1987 | Japan . | |
| 227989 | 9/1988 | Japan | 415/90 |
| 280893 | 11/1988 | Japan . | |
| 314397 | 12/1988 | Japan | 415/90 |
| 46495 | 3/1989 | Japan . | |

*Primary Examiner*—Edward K. Look
*Assistant Examiner*—James A. Larson
*Attorney, Agent, or Firm*—Antonelli, Terry, Stout & Kraus

[57] ABSTRACT

A vacuum pump of the present invention comprises a housing including a suction port and an exhaust port, a stator fixed in the housing, a rotor rotatably supported in the housing, and a cooling jacket provided adjacent to the stator. Gas suctioned from the suction port and having a pressure substantially equal to or close to the atmospheric pressure is exhausted from the exhaust port. A cooling fluid having a thermal conductivity less than that of water, for example, of 0.08 to 0.25 Kcal/m.h.°C. flows through the cooling jacket. When the gas contains aluminum chloride, the cooling fluid flows into the cooling jacket in such a manner that the temperature inside a gas conduit is maintained to be higher than the sublimation temperature of aluminum chloride. Lubrication oil may be supplied as the cooling fluid to the cooling jacket from the same supply line as lubrication oil supplied to oil lubricating bearings provided below a pump mechanism unit. A closed-loop line may be comprised of the cooling jacket, a tank, the supply line, and a return line, to thereby circulate the cooling fluid by a pump.

8 Claims, 7 Drawing Sheets

VACUUM PUMP

BACKGROUND OF THE INVENTION

The present invention relates to a vacuum pump used for an exhaust pump, for example, in a semiconductor manufacturing apparatus, and more particularly, to a vacuum pump which is operated under the condition that pressure of gas passing through an exhaust port of the pump is substantially equal to or close to the atmospheric pressure; with the vacuum pump being a dry-type pump employed in a process having such a tendency that reaction products are liable to stick to the inside of the pump.

A dry-type vacuum pump is advantageous in that a clean vacuum can be obtained because there is no oil or water in a conduit where gas fed from a suction port passes, meanwhile an effect to remove heat generated when the gas is compressed is restricted so that the temperature inside the pump becomes high. For the reason, conventionally, a cooling jacket is provided on the outside of a heat generating portion in order to cool the same by water. Referring to FIG. 7, a conventional dry vacuum pump includes a rotor 4 rotatably supported by bearings 6 in a casing 3, with the vacuum pump including a suction port 1 and an exhaust port 2, and a stator 5 securely fixed in the casing 3. Gas suctioned from the suction port 1 is successively compressed in multi-stage due to the compression function of a pump mechanism unit comprised of the rotor 4 and the stator 5, and is then discharged via the exhaust port to the atmosphere. In the compressing process of the gas, heat is generated by compressing the gas and the amount of the compression heat of the gas increases as the gas arrives nearer the exhaust port 2. For the purpose of removing this compression heat, in the conventional example shown in FIG. 7, a cooling jacket 7 is provided on an exterior of the stator 5 for cooling the stator 5 by water supplied from a water supply port 8.

An example of this type of conventional technique is disclosed in, for example, Japanese Patent Unexamined Publication No. 62-29796 or Japanese Utility Model Unexamined Publication No. 64-46495.

In the above-described conventional technique, water is mainly used as a cooling medium to have so large specific heat and so large thermal conductivity that its cooling effect is very preferable. However, the conventional technique is disadvantageous in that, when gas suctioned by a vacuum pump is one whose sublimation temperature is high, i.e., which is liable to be solidified even at a low temperature, the gas is transferred into the solid phase if the interior of the pump is cooled excessively, and the gas is solidified to adhere to or accumulate on the interior of the pump as a reaction product so that a conduit in the pump is clogged and a rotor is unfavorably locked. In order to resolve these problems, as disclosed in Japanese Utility Model Unexamined Publication No. 64-46945, the temperature of a stator is maintained at a predetermined value by controlling an amount of circulating cooling water. However, if an amount of the cooling water is decreased to be less than a predetermined amount, the overall cannot uniformly be cooled, which results in a problem that an efficiency of the vacuum pump is degraded. Further, a flow meter is required for controlling the amount of the cooling water. Since bleaching powder precipitates at a narrow portion of the flow meter, there also occurs a problem that the temperature of the pump cannot be reliably controlled.

Incidentally, though it is suggested to provide a heater only at an exhaust port of the vacuum pump so as to prevent the sublimate gas from solidification, the method of heating the gas by provision of the heater is disadvantageous in that the heater is sometimes not operationally reliable. A sublimate gas is a gas which separates out of a solid which is at or below a sublimation temperature.

SUMMARY OF THE INVENTION

One object of the present invention is to provide a vacuum pump wherein even if gas of a high sublimation temperature is suctioned into a conduit of the pump, the gas is not solidified so that a reaction product is prevented from adhering to or accumulating on the pump conduit.

Another object of the invention is to provide a vacuum pump wherein suction gas is prevented from being solidified without largely reducing an amount of a cooling liquid as circulated, thereby avoiding a solidified substance from adhesion to a conduit of the pump.

Still another object of the invention is to provide a vacuum pump which is suitable for use in a semiconductor manufacturing apparatus, and wherein solidification of reaction gas used in the semiconductor manufacturing apparatus is suppressed so that a reaction product resulted from the reaction gas does not adhere to or accumulate on inner wall surfaces of a stator or a casing of the pump.

A further object of the invention is to provide a vacuum pump wherein a reaction product is prevented from adhering to or accumulating on a conduit of the pump, whereby and a stator thereof can be uniformly cooled uniformly.

In order to achieve the above-described objects, according to the invention, the temperature inside the pump is evenly increased by reducing a thermal conductivity of inner surfaces of a cooling jacket, whereby a substance of a high sublimation temperature can be kept at a temperature exceeding the temperature of its gaseous phase.

The present invention provides a vacuum pump comprising a housing including a suction port and an exhaust port through which gas suctioned from the suction port is exhausted to have a pressure substantially equal to or close to the atmospheric pressure, a stator fixed in the housing, and a rotor rotatably supported in the housing. A cooling jacket is provided adjacent to the stator for cooling the same, and a cooling liquid having a thermal conductivity less than a thermal conductivity of water flows through the cooling jacket.

Also, the invention provides a vacuum pump comprising a housing including a suction port and an exhaust port, a rotary shaft rotatably supported in the housing, a stator fixed to an inner wall of the housing, and a rotor attached to the rotary shaft, with the stator and rotor being in a mating relationship so as to constitute pump stages, thereby discharging gas suctioned from the suction port through the exhaust port directly into the atmosphere. The stator is provided with a cooling jacket on the outer periphery, and a coolant having a conductivity within a range of 0.08 to 0.25 Kcal/m.h.° C. is supplied to the cooling jacket.

Further, the invention provides a vacuum pump for suctioned gas containing aluminum chloride ($AlCl_3$), compressing the gas to have a pressure substantially equal to or close to the atmospheric pressure, and thereafter exhausting the compressed gas. A cooling jacket is provided for cooling a conduit, and a cooling liquid having a lower thermal conductivity than a thermal conductivity of water flows through the cooling jacket to cool the conduit while maintaining the temperature inside the conduit higher than the sublimation temperature of aluminum chloride.

In accordance with further features of the invention a vacuum pump comprises a pump mechanism unit including a stator and a rotor accommodated in a casing with a suction port and an exhaust port through which gas suctioned from the suction port is discharged, and oil lubricating bearings provided below the pump mechanism unit. A cooling jacket is provided on the outer periphery of the stator, and lubrication oil which is the same as lubrication oil supplied to the oil lubricating bearings is supplied to the cooling jacket, to thereby cool the pump mechanism unit.

Furthermore, the invention provides a vacuum pump for successively compressing gas suctioned from a suction port in multi-stage by a pump mechanism unit provided in a pump casing, and exhausting the gas to have a pressure substantially equal to the atmospheric pressure through an exhaust port, wherein the pump is provided with a cooling jacket for cooling the pump mechanism unit through which a cooling liquid having a thermal conductivity less than a thermal conductivity of water flows, and the pump also includes means for controlling the temperature of the cooling liquid.

Moreover, the invention provides a vacuum pump successively compressing in multi-stages fluid containing sublimate gas suctioned from a suction port by means of a pump mechanism unit provided in a pump casing, and exhausting the fluid having a pressure substantially equal to the atmospheric pressure through an exhaust port. A cooling jacket is provided adjacent to the pump mechanism unit, a line for supplying a cooling liquid from a tank to the cooling jacket and a line for returning the cooling liquid from the cooling jacket to the tank are provided to constitute a closed-loop system of the cooling liquid, a supply pump is provided in the closed-loop system to circulate the cooling liquid supplied from the tank to the cooling jacket, and means for controlling the temperature of the cooling liquid is provided to maintain the temperature of a conduit wall in the vacuum pump to be higher than the sublimation temperature of the sublimate gas.

Further, the invention provides a vacuum pump compressing low-pressure gas suctioned from a suction port due to a function of a pump section comprising of a rotor and a stator provided in a casing, and exhausting the compressed gas from an exhaust port into the atmosphere. A cover of a cooling jacket provided on the outer periphery of the stator is detachable.

The present invention is arranged in such a manner that there is provided a cooling jacket for cooling a stator wherein a cooling fluid having a thermal conductivity less than a thermal conductivity of water, preferably a cooling medium having a thermal conductivity in the range of 0.08 to 0.25 Kcal/m.h.° C. such as #90 turbine oil, #140 turbine oil, or vacuum oil is supplied to cool the stator, so that the temperature of the stator can be maintained at a certain value without largely reducing a flow rate of cooling liquid supplied to the cooling jacket. Since, even when suction gas is compressed, the temperature of the gas can be maintained higher than the sublimation temperature when the gas is compressed, a solidified substance of the suction gas can be prevented from adhering to or accumulating on a conduit of the vacuum pump and nonuniformity in cooling the pump can be also avoided because it is unnecessary to reduce the flow rate of the cooling liquid.

More specifically, according to the invention, in a vacuum pump for suctioned gas containing aluminum chloride ($AlCl_3$), compressing the gas to have a pressure close to the atmospheric pressure, and discharging the compressed gas, since the temperature inside a conduit of the pump can be maintained at a value higher than the sublimation temperature of aluminum chloride under the pressure, it is possible to prevent aluminum chloride from being solidified and adhering to or accumulating on inner walls of the conduit or the like.

Incidentally, even if warm water which is controlled to be at a certain temperature is used as a cooling liquid, the temperature inside the conduit in the vacuum pump can be maintained to exceed a predetermined temperature and nonuniformity in cooling the conduit can be prevented without largely reducing the flow rate of the cooling liquid, similarly to the case where a cooling liquid having a thermal conductivity less than a thermal conductivity of water is used.

Gas discharged from a reaction furnace in a semiconductor manufacturing apparatus is solidified unless the temperature thereof is higher as the pressure thereof is closer to the atmospheric pressure due to a relationship between a steam pressure and a temperature of the gas, so that a resulting reaction product from the gas adheres to or accumulates on the pump conduit.

Because the pump generates a large amount of heat due to its compression function, if a thermal conductivity of an inner surface of the cooling jacket is reduced, the pump conduit can be constantly maintained at a high temperature. Therefore, a reaction product can be prevented from adhering to or accumulating on the pump conduit because the gas passing through the pump conduit is constantly maintained at a high temperature.

DESCRIPTION OF THE PREFERRED EMBODIMENTS

In the present invention, a liquid such as oil whose specific heat and thermal conductivity are smaller than a specific heat and thermal conductivity of water is used as a cooling medium, so that a pump will be uniformly cooled to be maintained inside thereof at a temperature not less than a predetermined temperature or without excessive cooling, and a substance of a high sublimation temperature to be suctioned from a suction port is heated to have a temperature exceeding the sublimation temperature in order to be maintained in a gaseous state and not to be solidified to adhere to or accumulate on a conduit.

Figure 1:
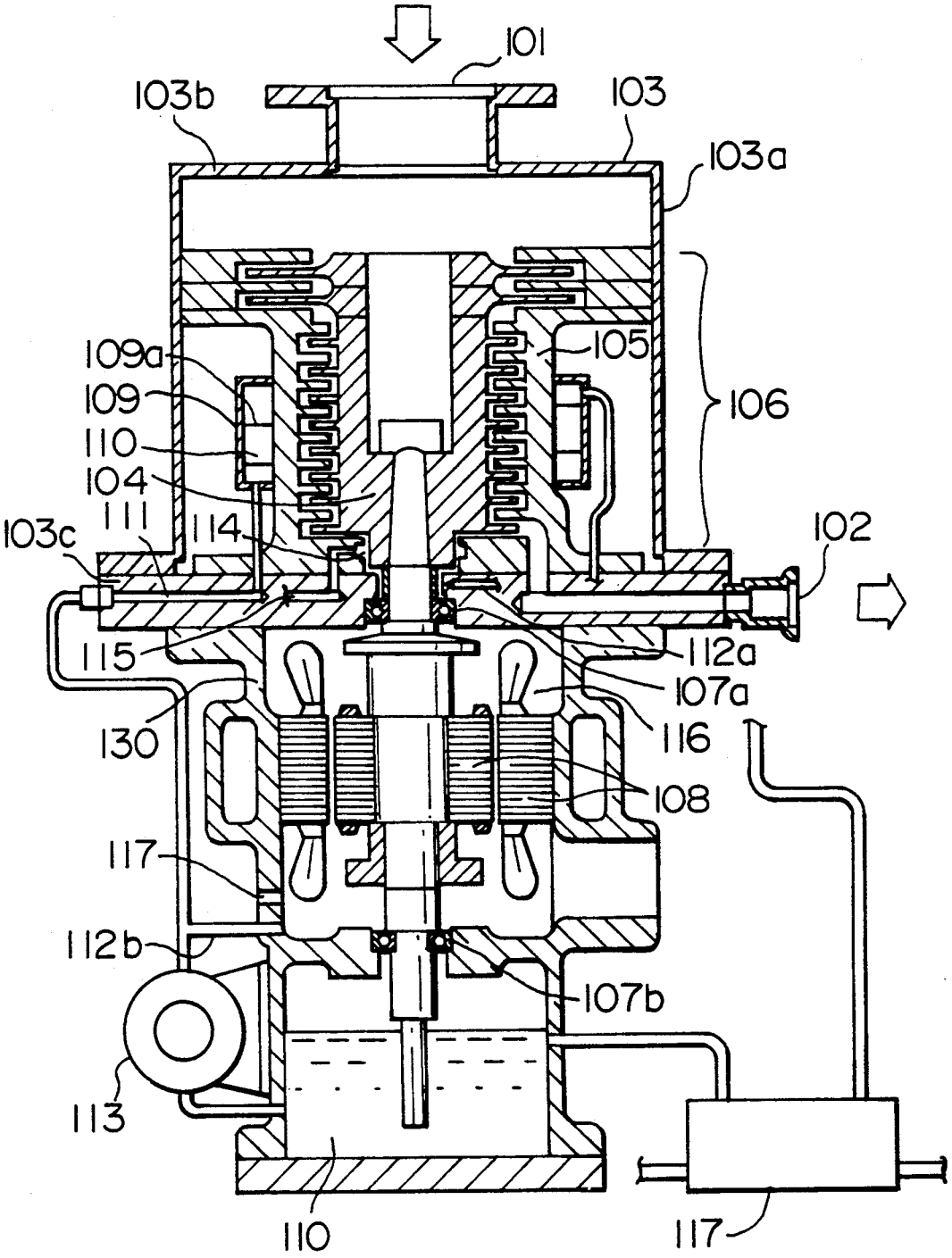
FIG. 1 is a vertical cross-sectional view of showing a vacuum pump according to a first embodiment of the present invention.

Referring now to the drawings wherein like reference numerals are used throughout the various views to designate like parts and, more particularly, to FIG. 1, according to this figure, a vacuum pump in accordance with the present invention comprises a housing or casing 103 including a cylindrical portion 103*a* and upper and lower end plates 103*b* and 103*c*. The upper end plate 103*b* is formed with a suction port 101, and the lower end plate 103*c* is formed with an exhaust port 102. A motor housing 130 is provided below the lower end plate 103*c*. In the housing 103 including the suction port 101 and the exhaust port 102, there is installed a pump mechanism unit 106 including a rotor 104 and a stator 105. The rotor 104 is supported by upper and lower bearings 107*a* and 107*b* and driven by a motor 108 within the motor housing 130, and the stator 105 is provided to surround the rotor 104. Gas suctioned from the section port 101 is successively compressed in multi-stages due to the compression function of the rotor 104 and the stator 105, and then the compressed gas is discharged via the exhaust port 102 to the atmosphere. A cooling jacket 109 is provided on the outer peripheral side of the stator 105. Lubrication oil 110 which has collected in a bottom portion of the motor housing 130 is supplied via an oil supply port 111 to the cooling jacket 109 by means of an oil pump 113. Heat generated when the gas suctioned from the suction port 101 is compressed is carried away by the oil 110 supplied to the cooling jacket 109. A rib 109*a* is formed on the inner surface of the cooling jacket 109 so that the cooling fluid (oil) supplied to a lower portion of the jacket will flow upwardly revolving round the stator 105 in the peripheral direction thereof until it is discharged from an upper portion of the cooling jacket 109 to thereby make the temperature distribution of the stator 105 uniform in the peripheral direction.

As shown in FIG. 1, the cooling jacket 109 does not cover the final stage of the rotor and stator. This is because it is necessary to maintained a high temperature at a high pressure region of the pump, and because the final stage of the rotor and stator cooled by seal gas can be prevented from being excessively cooled.

Figure 2:
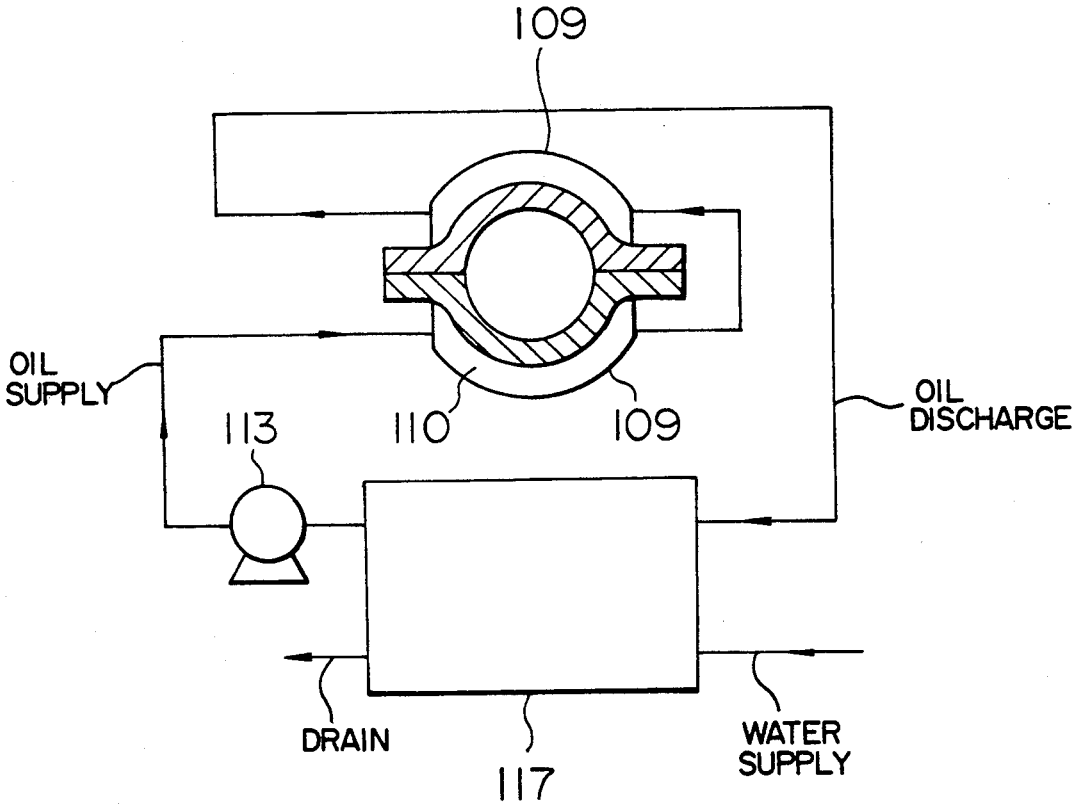
FIG. 2 is an explanatory schematic view illustrative of flow of a coolant in the embodiment of FIG. 1.

As shown in FIG. 2, the lubrication oil supply system is a closed-loop system. The oil 110 which has absorbed the gas compression heat at the cooling jacket 109 and increased in temperature is cooled by cooling water or the like in an oil cooler 117, and thereafter the oil is supplied again to the cooling jacket 109 by the oil pump 113. The temperature of the lubrication oil is controlled by the oil cooler 117.

In this embodiment, as shown in FIG. 1, the oil pump 113 also serves to supply the lubrication oil to the rolling bearings 107*a* and 107*b*. The flow passages of the lubrication oil to the bearings are composed of the common closed-loop line with the flow passage of the cooling medium to the cooling jacket. That is to say, part of the lubrication oil discharged from the oil pump 113 flows through oil supply ports 112*a* and 112*b* so as to be fed to the upper and lower bearings 107*a* and 107*b*, respectively. With this arrangement, the cooling medium line can also serve as the lubrication oil line to provide a compact apparatus.

A shaft seal portion 114 is formed between the pump mechanism unit 106 and the upper bearing 107*a*, and seal gas is supplied to this shaft seal portion 114 through a seal gas supply port 115 from the outside of the apparatus. For example, dry nitrogen is used as a seal gas so that it will not react with the gas suctioned from the suction port 101. The seal gas discharged from the seal gas supply port 115 toward the surface of the rotor 104 is divided into upward and downward flows. Part of the seal gas flows into the pump mechanism unit 106 and is discharged from the exhaust port 102 with the gas fed from the suction port 101, whereas the rest of the seal gas flows through the upper bearing 107*a* into a motor chamber 116 and is discharged from a seal gas discharge port 117. These two flows of the seal gas can prevent the lubrication oil fed to the bearings from entering the pump mechanism unit 106, and can also prevent the gas fed from the suction port 101 from entering the motor chamber 116.

The gas suctioned from the suction port 101 is successively compressed in multi-stages in a conduit of the pump mechanism unit 106 including the rotor 104 and the stator 105, and thereafter the compressed gas is discharged from the exhaust port 102 into the atmosphere. When the gas is discharged, it is heated to have a high temperature in a region where the rotor 104 is rotated at high speeds, and this heat is transmitted to the stator 105. If such a condition is unchanged, the gas temperature is increased, and consequently, the high-temperature gas degrades compression performance of the pump mechanism unit 106, thus deteriorating its pumping function, while it causes thermal expansion which brings the rotor 104 and the stator 105 into contact with each other. In the present invention, however, the stator 105 can be cooled by the cooling jacket 109 through which the lubrication oil is made to flow, and can be maintained at a certain temperature by reliable cooling operation.

Figure 3:
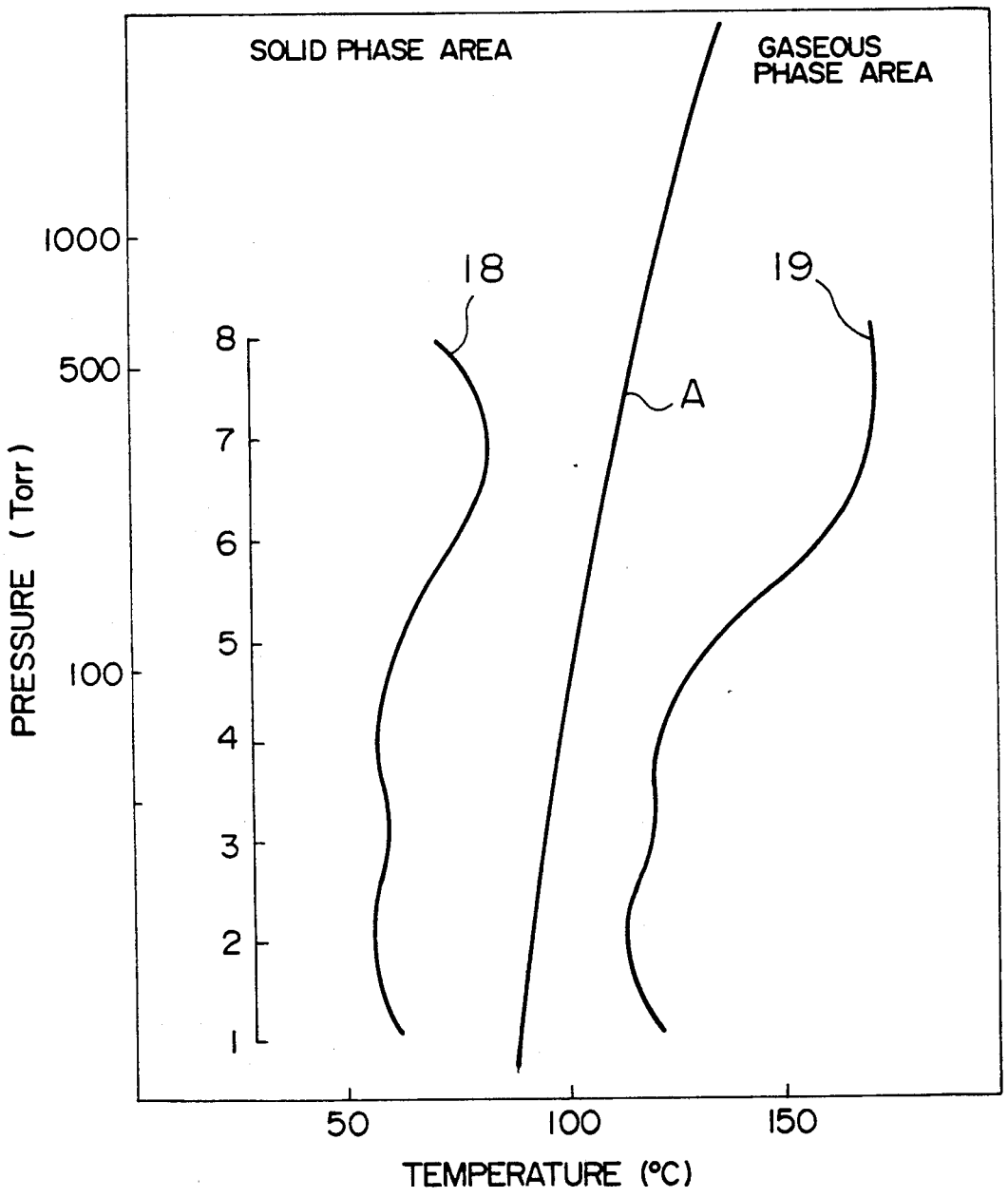
FIGS. 3 and 4 are respectively graphs showing a characteristic curve of sublimation temperature of aluminum chloride ($AlCl_3$) and a temperature of a stator at each stage of the invention, in comparison with that of the prior art.

For example, when the suction port 101 of the vacuum pump is connected with a reactor of an aluminum dry etching device of a semiconductor manufacturing apparatus, aluminum chloride ($AlCl_3$) is generated as a reaction product after etching. FIG. 3 shows a graph of temperatures relative to pressures where a characteristic curve A of sublimation temperature of aluminum chloride represents a boundary line between a solid-phase side and a gaseous-phase side. In FIG. 3, a curve 18 denotes data of a conventional example, and a curve 19 denotes data of a particular embodiment of the present invention.

If water cooling is conducted by supplying water to the cooling jacket 109, the temperature inside the stator 105 will be on the solid-phase side of the characteristic curve A of sublimation temperature of aluminum chloride. Therefore, aluminum chloride (hereinafter referred to as $AlCl_3$) will be solidified and adhere to or accumulate on the inner wall of the stator 105. In this embodiment, the oil is supplied to the cooling jacket 109 so as to cool the stator 105. Since the thermal conductivity of oil is as small as about 1/5 of that of water, the temperature inside the stator 105 can be increased by oil when water and oil having the same temperature are used. As a result, the temperature inside the stator 105 can be maintained on the gaseous-phase side of the characteristic curve A of sublimation temperature of $AlCl_3$ to thereby prevent the reaction product from adhering to the inner wall of the stator 105.

Figure 4:
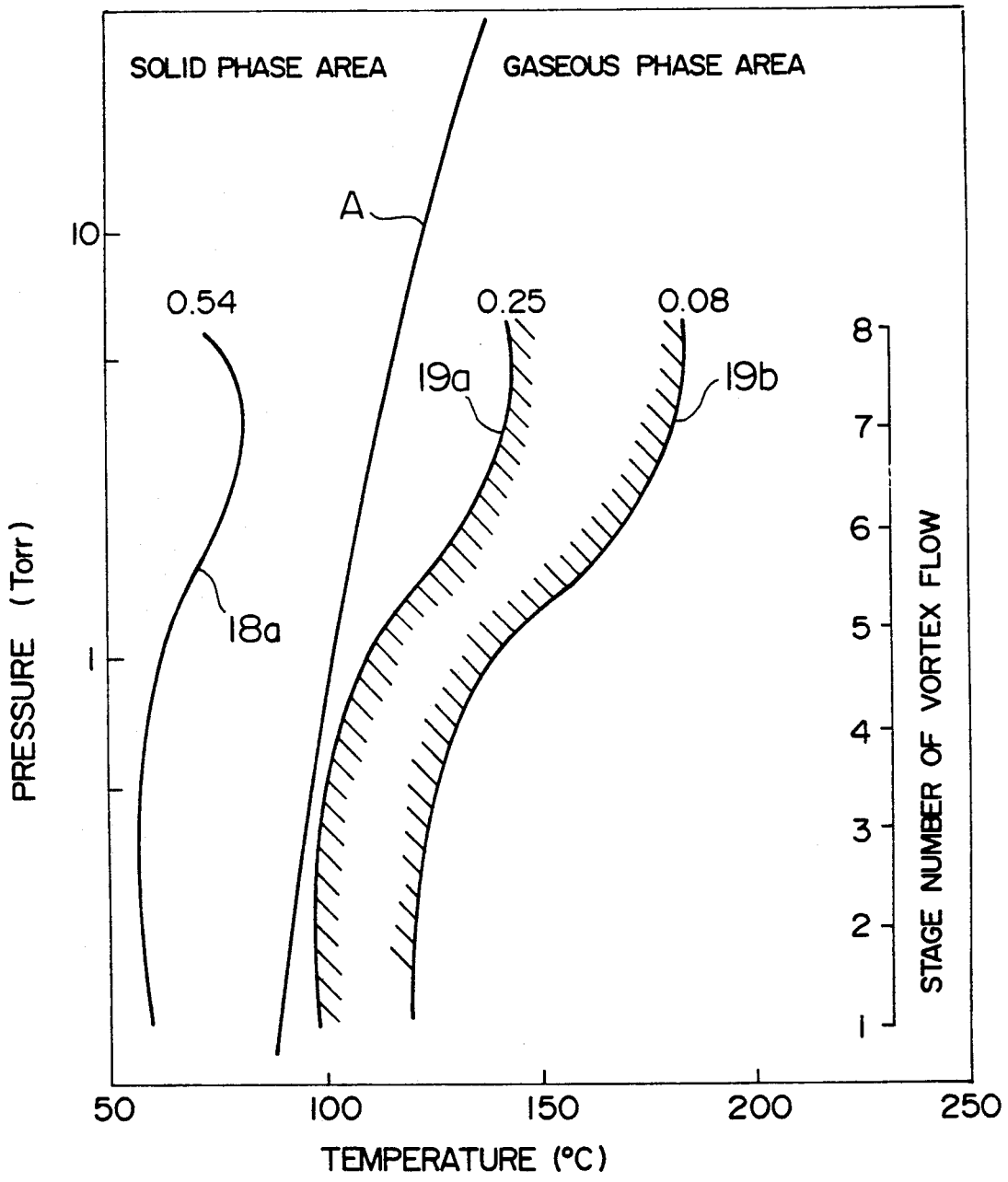

The function of the present invention will be described more specifically with reference to FIG. 4.

In this graph, a curve 18*a* represents data of a conventional example, and curves 19*a*, 19*b* represent data of a particular embodiment of the present invention.

If water cooling is conducted by supplying water to the above-described cooling jacket 109, the temperature inside the stator 105 will be on the solid-phase side of the characteristic curve A of sublimation temperature of $AlCl_3$, and therefor, $AlCl_3$ will adhere to or accumulate on the inner wall of the stator 105. The thermal conductivity of water at a temperature of 40° C. is 0.54 Kcal/m.h.° C. and larger than that of oil or the like. In the present invention, a cooling medium having a thermal conductivity of 0.08 to 0.25 Kcal/m.h.° C. is supplied to the cooling jacket 109. As a suitable cooling medium which satisfies this condition, there can be proposed lubrication oil (#90 turbine oil, #140 turbine oil), vacuum oil (of alkyldiphenyl ether, of perfluoropolyether), mineral oil, synthetic oil, ethylene glycol, ethyl alcohol and the like. For example, in the case where lubrication oil is used as the cooling medium, the thermal conductivity of the lubrication oil is about 1/5 of that of water, and consequently, the temperature of the lubrication oil can be kept higher when water and the lubrication oil having the same temperature are used, so that the temperature inside the stator 105 can be made higher by the lubrication oil, and that the temperature inside the stator 105 can be maintained on the gaseous-phase side of the characteristic curve A of sublimation temperature of $AlCl_3$. As a result, the reaction product can be prevented from adhering to the inner wall of the stator 105.

In the present invention, there is used a cooling medium having a thermal conductivity in the range of 0.08 to 0.25 Kcal/m.h.° C. for the following reason. If a cooling medium having a thermal conductivity of 0.25 Kcal/m.h.° C. is used, the temperature of the stator 105 varies from its first stage to the eighth stage, as indicated by a curve 19*a* in FIG. 4, and part of the curve 19*a* is quite close to the characteristic curve A of sublimation temperature of $AlCl_3$. Accordingly, if a cooling medium having a large thermal conductivity is used, $AlCl_3$ may be solidified. In order to prevent $AlCl_3$ from being solidified, therefore, a cooling medium having a thermal conductivity of 0.25 Kcal/m.h.° C. or less is preferably used. On the other hand, if a cooling medium having a thermal conductivity of 0.08 Kcal/m.h.° C. is used, the temperature of the stator 105 can be maintained substantially as indicated by a curve 19*b* in FIG. 4. If a cooling medium having a small thermal conductivity is used, however, the stator 105 will not be sufficiently cooled sufficiently, and will have a high temperature. In case it exceeds about 250° C., sealing material interposed between mating faces of the stator 105 may be broken, or cooling of compressed gas may become insufficient, thus deteriorating the compression performance. The stator 105 should be maintained at a temperature not more than 250° C., and therefore, a cooling medium having a thermal conductivity of 0.08 Kcal/m.h.° C. or more is preferably used.

In the first embodiment shown in FIG. 1, the oil cooler 117 is provided outside of the motor housing 130. Alternatively, the oil cooler 117 may be provided inside the motor housing 130.

Figure 5:
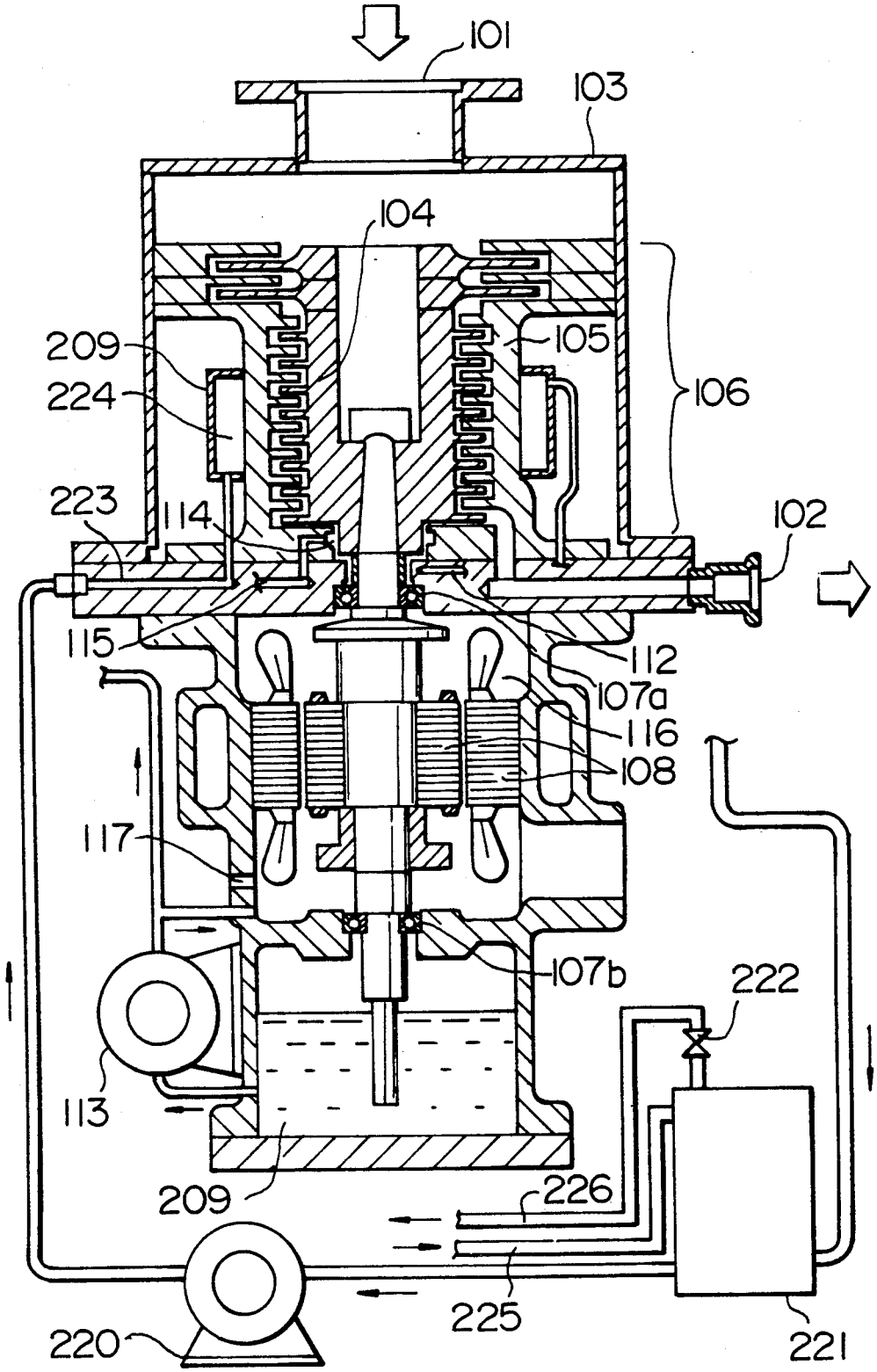
FIG. 5 is a vertical cross-sectional view of a vacuum pump according to a second embodiment of the invention.

In the first embodiment, the flow passage of the lubrication oil to the bearings include the common closed-loop line with the flow passage of the cooling medium to the cooling jacket. In the second embodiment of FIG. 5 the lubrication oil line is used only for supplying oil to the upper and lower bearings 107*a* and 107*b*, and the stator 105 is cooled by warm water supplied by a supply pump 220 additionally provided. More specifically, cooling operation is conducted through a closed-loop line in such a manner that water which has been supplied from a water tank 221 is introduced into a cooling jacket 209 through a water supply port 223 by the supply pump 220, and that water thus introduced into the cooling jacket 209 is gradually warmed, through the stator 105, by heat generated due to the gas compression function of the rotor 104 and the stator 105, with this warm water being returned to the water tank 221. If the line is completely closed, warm water in such a closed-loop line will be gradually increased in temperature, and eventually, it will have quite a high temperature. Therefore, in order to maintain warm water in the closed-loop line at a predetermined temperature, cooling water is supplied to the water tank 221 through a water supply pipe 225, and warm water is discharged out of the water tank 221 through a water drain pipe 226. The water drain pipe 226 is provided with a temperature regulating valve 222 for discharging warm water out of the water tank 221 to the outside and introducing water from the outside into the water tank 221. The temperature regulating valve 222 serves to control warm water 224 within the water tank 221 at a predetermined temperature. By way of the valve 222 warm water is discharged out of the water tank 221 so that the temperature inside the stator 105 can be maintained on the gaseous-phase side of the characteristic curve A of sublimation temperature of $AlCl_3$ in FIG. 3 or 4. Thus, the reaction product can be prevented from being solidified and adhering to a pump conduit such as the inner wall of the stator 105.

Figure 6:
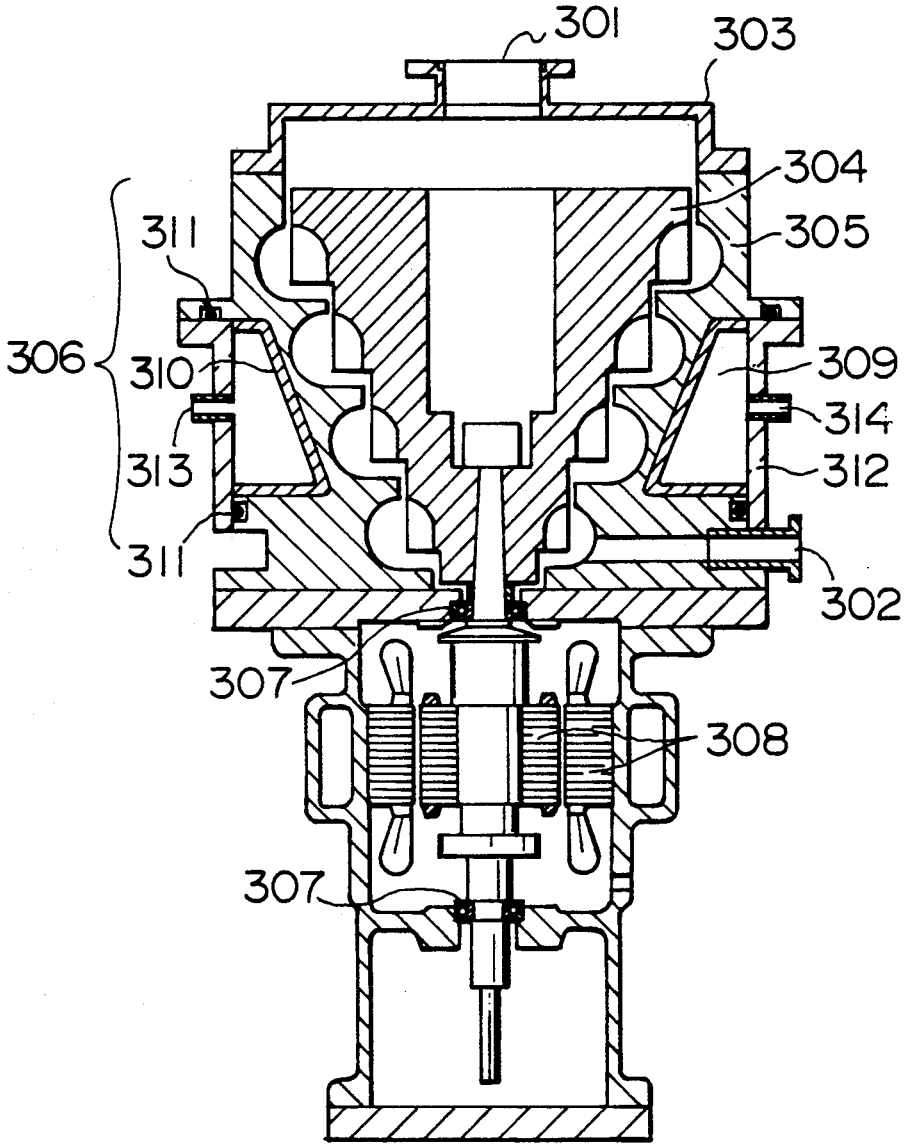
FIG. 6 is a vertical cross-sectional view of a vacuum pump according to a third embodiment of the invention.
Figure 7:
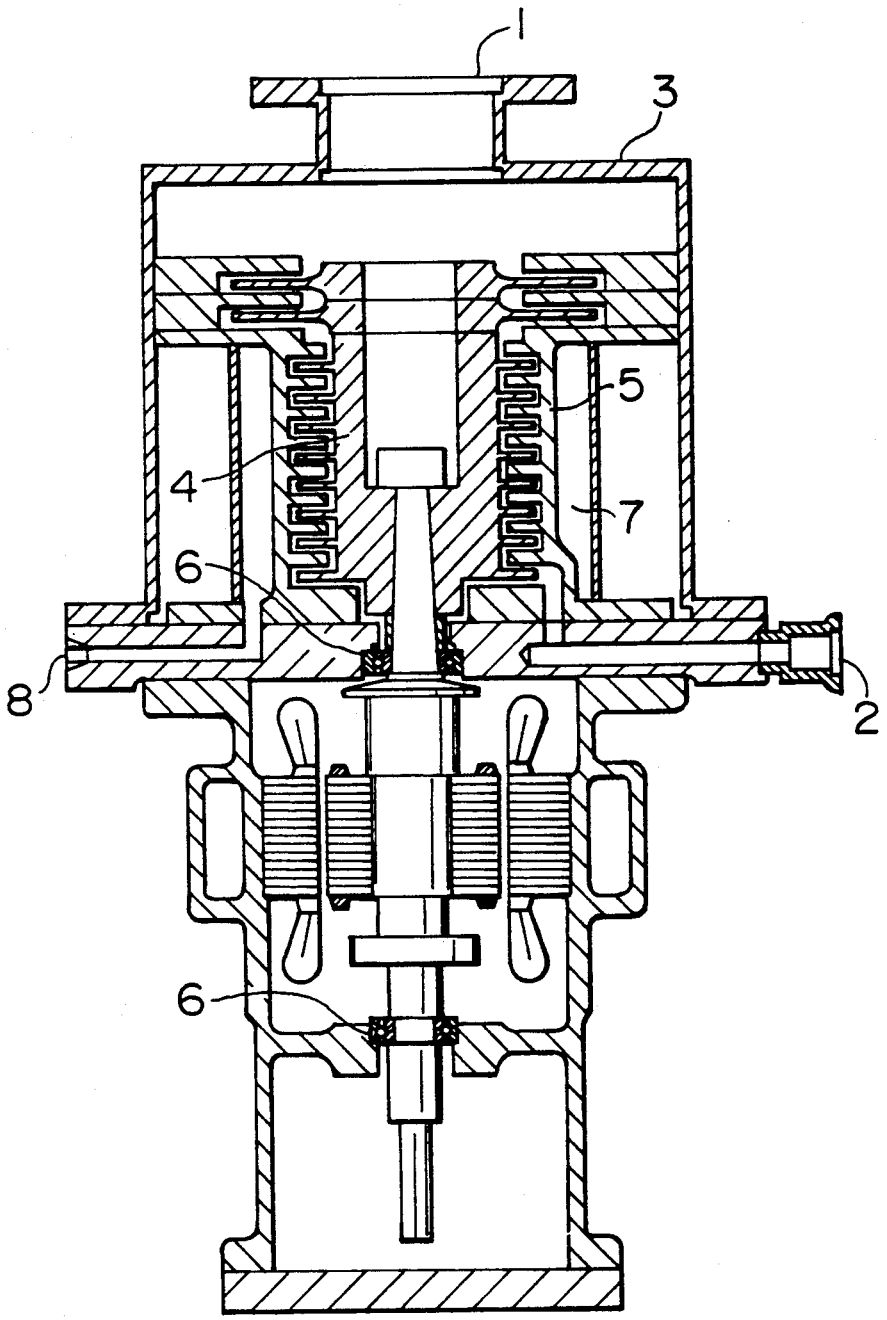
FIG. 7 (PRIOR ART)
FIG. 7 is a vertical cross-sectional view of a vacuum pump according to the prior art.

As shown in FIG. 6, a pump mechanism unit 306 includes a rotor 304 and a stator 305. The rotor 304 is supported by bearings 307 and driven by a motor 308, and the stator 305 is provided to surround the rotor 304. The pump mechanism unit 306 is provided in a casing 303 having a suction port 301 and an exhaust port 302. Gas suctioned from the suction port 301 is successively compressed in multi-stages due to the compression function of the rotor 304 and the stator 305, and then the compressed gas is discharged from the exhaust port 302 into the atmosphere. A cooling jacket 309 is provided outside the stator 305, and a plastic plate 310 is secured to the inner surface of the cooling jacket 309 with an adhesive. The cooling jacket 309 is sealed by O-rings 311 made of rubber and is placed in a space closed by a jacket cover 312. The jacket cover 312 is provided with a water supply port 313 and a water drain port 314. Cooling water which has been introduced from the water supply port 313 absorbs heat generated when gas is compressed in the pump mechanism unit 306, and is discharged from the water drain port 314.

In operation, the gas suctioned from the suction port 301 is successively compressed in multi-stages in a conduit of the pump mechanism unit 306 including the rotor 304 and the stator 305, and thereafter the compressed gas is discharged via the exhaust port 302 into the atmosphere. When the gas is discharged, it is heated to have a high temperature in a region where the rotor 304 is rotated at high speeds, and this heat is transmitted to the stator 305. If such a condition is unchanged, the gas temperature is increased, and consequently, the high-temperature gas degrades compression performance of the pump mechanism unit 306, thus deteriorating its pumping function, while it causes thermal expansion which brings the rotor 304 and the stator 305 into contact with each other. For this reason, the stator 305 is cooled by the cooling jacket 309 through which cooling water is made to flow.

For example, when the suction port 301 of the vacuum pump is connected with a reactor of an aluminum dry etching device of a semiconductor manufacturing apparatus, $AlCl_3$ is generated as a reaction product after etching. FIG. 3 shows the graph of temperatures relative to pressures where the characteristic curve A of sublimation temperature of $AlCl_3$ represents the boundary line between the solid-phase side and the gaseous-phase side.

If the stator 305 is cooled directly by the cooling jacket 309 through which cooling water is made to flow, the temperature inside the stator 305 will be on the solid-phase side of the characteristic curve A of sublimation temperature of $AlCl_3$. Therefore, $AlCl_3$ will be solidified and adhere to or accumulate on the inner wall of the stator 305. It is for this reason that the plastic plate 310 is secured to the inner surface of the cooling jacket 309. Since the thermal conductivity of plastic material is as small as about 1/10 of that of iron, the temperature gradient between cooling water and the gas inside the stator 305 is increased so as to keep the gas temperature higher. As a result, the temperature inside the stator 305 can be maintained on the gaseous-phase side of the characteristic curve A of sublimation temperature of $AlCl_3$ to thereby prevent the reaction product from adhering to or accumulating on the inner wall of the stator 305.

In place of the plastic plate 310, a non-plastic material having a thermal conductivity smaller than a thermal conductivity of a metal may be secured to the inner surface of the cooling jacket 309, or the inner surface of the cooling jacket 309 may be coated with a liquid material which is solidified into a film having a low thermal conductivity, so that the same effect can be obtained.

According to the present invention, the temperature of the stator can be maintained so as not to be less than a certain value without greatly reducing a flow rate of cooling fluid supplied to the cooling jacket. Therefore, cooling can be effected reliably, and suction gas can be prevented from being solidified and adhering to or accumulating on a conduit of the vacuum pump.

What is claimed is:

1. In a vacuum pump for suctioning gas containing aluminum chloride ($AlCl_3$), compressing the gas to have a pressure substantially equal to or close to atmospheric pressure, and therafter exhausting the compressed gas, the improvement wherein a cooling jacket is provided for cooling a conduit, and a cooling liquid having a thermal conductivity less than a thermal conductivity of water flows through said cooling jacket to cool the conduit while maintaining a temperature inside the conduit higher than a sublimation temperature of the aluminum chloride.

2. In a vacuum pump comprising a pump mechanism unit including a stator and a rotor accommodated in a casing with a suction port and an exhaust port through which gas suctioned from said suction port is discharged, and oil lubricating bearing provided below said pump mechanism unit, the improvement wherein a cooling jacket is provided on an outer periphery of said stator, and lubrication oil which is the same as a lubrication oil supplied to the oil lubricating bearings is supplied to said cooling jacket, to thereby cool said pump mechanism unit.

3. A vacuum pump according to claim 2, wherein flow passages for the lubrication oil to the bearings are formed as a closed-loop line with a flow passage of a cooling medium to the cooling jacket.

4. A vacuum pump according to claim 3, wherein said oil lubricating bearings are roller bearings, and said pump includes a shaft seal portion located between said pump mechanism unit and an upper one of said roller bearings and to which seal gas is supplied from outside of said pump.

5. A vacuum pump according to claim 2, wherein said gas suctioned from said suction port is compressed to have a pressure substantially equal to or close to atmospheric pressure within said pump mechanism unit and is then discharged from said exhaust port into the atmosphere.

6. A vacuum pump according to claim 2, wherein said pump includes an oil cooler for cooling said lubrication oil.

7. In a vacuum pump successively multi-stage compressing of a fluid containing gas suctioned from a suction port by a pump mechanism unit provided in a pump casing, and exhausting said fluid having a pressure substantially equal to atmospheric pressure through an exhaust port, the improvement wherein a cooling jacket is provided adjacent to said pump mechanism unit, a line for supplying a cooling liquid from a tank to said cooling jacket and a line for returning said cooling liquid from said cooling jacket to said tank are provided and form a closed-loop system of said cooling liquid, a supply pump is provided in said closed-loop system to circulate said cooling liquid supplied from said tank to said cooling jacket, and means for controlling the temperature of said cooling liquid is provided to maintain the temperature of a conduit wall in said vacuum pump higher than a sublimation temperature of said gas.

8. A vacuum pump according to claim 7, wherein said cooling liquid is warm water heated due to compression heat of said pump mechanism unit, and means for cooling said warm water is provided in said tank to maintain said warm water at a predetermined temperature.

* * * * *